US011358826B2

(12) United States Patent
Schwab

(10) Patent No.: US 11,358,826 B2
(45) Date of Patent: Jun. 14, 2022

(54) METHOD OF GROUPING SHEET UNITS BELONGING TO SHEET GROUPS, A GROUPING UNIT AND A SHEET HANDLING SYSTEM

(71) Applicant: BÖWE SYSTEC GmbH, Augsburg (DE)

(72) Inventor: Franz Schwab, Augsburg (DE)

(73) Assignee: BÖWE SYSTEC GmbH, Augsburg (DE)

( * ) Notice: Subject to any disclaimer, the term of this patent is extended or adjusted under 35 U.S.C. 154(b) by 145 days.

(21) Appl. No.: 16/811,302

(22) Filed: Mar. 6, 2020

(65) Prior Publication Data

US 2020/0283255 A1 Sep. 10, 2020

(30) Foreign Application Priority Data

Mar. 7, 2019 (DE) ..... 10 2019 105 864.3

(51) Int. Cl.
*B65H 39/11* (2006.01)
*B65H 37/00* (2006.01)

(52) U.S. Cl.
CPC ..... *B65H 39/11* (2013.01); *B65H 37/00* (2013.01)

(58) Field of Classification Search
CPC ..... B65H 39/11; B65H 37/00; B65H 29/125; B65H 29/145; B65H 39/06
See application file for complete search history.

(56) References Cited

U.S. PATENT DOCUMENTS 4,502,676 A * 3/1985 Stocker ..... B65H 31/24 209/564
4,572,497 A 2/1986 Dreschel et al.
4,805,891 A 2/1989 Luperti et al.
5,083,769 A * 1/1992 Young, Jr. ..... B65H 39/10 271/280
5,123,639 A * 6/1992 Edwards ..... B65H 29/145 271/212

(Continued)

FOREIGN PATENT DOCUMENTS

DE 10019699 A1 10/2001
DE 10 2014107037 B3 7/2015
EP 1222132 B1 8/2004

OTHER PUBLICATIONS

Result of examination report for German Patent Application No. 10 2019 105 864.3, filed Mar. 7, 2019.

(Continued)

*Primary Examiner* — Patrick H Mackey
(74) *Attorney, Agent, or Firm* — Paul D. Bianco; Stephen Bongini; Fielt Intellectual Property Law

(57) ABSTRACT

A method of grouping sheet units, which belong together in sheet groups, a sheet stream comprising two superposed sheet units each by means of a grouping unit, a grouping unit for a sheet handling system, and a sheet handling system that allow a high processing speed and a high cycle efficiency of a sheet handling system are disclosed. A sheet unit can be held back in the grouping unit. Depending on whether the downstream subsequent sheet units transferred into the grouping unit belong to a sheet group, the held-back sheet unit can be released by itself and together with one or together with both downstream subsequent sheet units.

20 Claims, 5 Drawing Sheets

(56) References Cited

U.S. PATENT DOCUMENTS

| | | | | |
|---|---|---|---|---|
| 5,704,604 | A * | 1/1998 | Koelle | B65H 31/3054 270/52.09 |
| 5,775,689 | A * | 7/1998 | Moser | B65H 29/145 271/198 |
| 6,161,828 | A | 12/2000 | Sussmeier | |
| 6,367,793 | B1 | 4/2002 | O'Dea et al. | |
| 6,776,409 | B2 * | 8/2004 | Cook | B65H 29/145 271/189 |
| 7,121,544 | B2 * | 10/2006 | Masotta | B65H 29/145 271/209 |
| 8,167,293 | B2 * | 5/2012 | Lewalski | B26D 9/00 270/52.17 |
| 2003/0080503 | A1 | 5/2003 | Wright et al. | |
| 2003/0107168 | A1 | 6/2003 | Schwab | |
| 2005/0056989 | A1 * | 3/2005 | Schwab | B65H 39/06 271/187 |
| 2013/0237397 | A1 | 9/2013 | Seiler | |

OTHER PUBLICATIONS

European Search Report dated Jun. 16, 2020 for Application No. 19 20 8884.

* cited by examiner

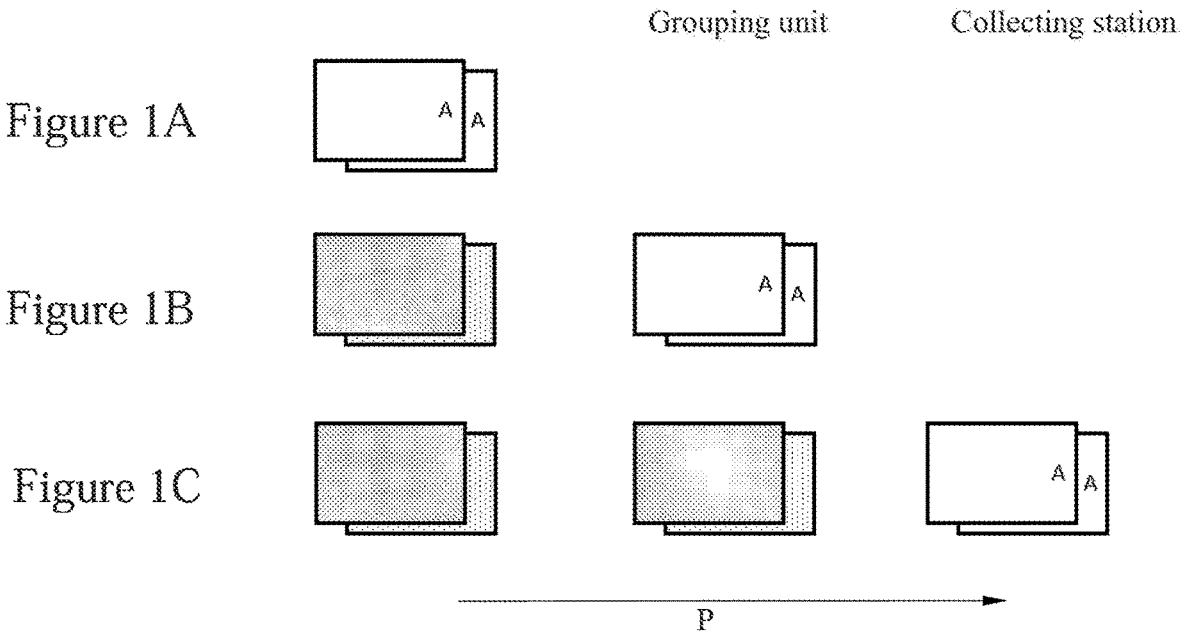
Grouping unit
Collecting station
Figure 1A
A
A
Figure 1B
A
A
Figure 1C
A
A
P
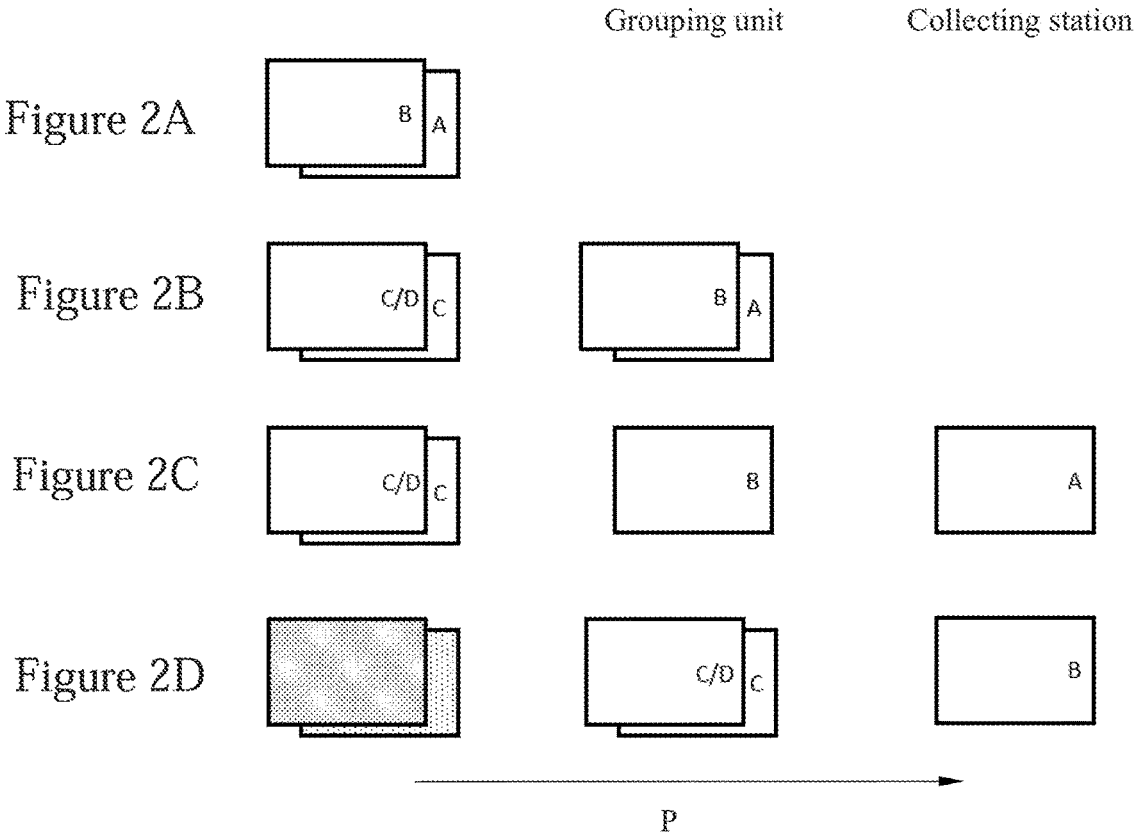
Grouping unit
Collecting station
Figure 2A
B
A
Figure 2B
C/D
C
B
A
Figure 2C
C/D
C
B
A
Figure 2D
C/D
C
B
P Grouping unit
Collecting station

B
A

B
B
B
A

B
B
B
A

B
B
B
A

B
B
B
P

Grouping unit
Collecting station

B
A

C
B
B
A

C
B
B
A

C
B
B
A

C
B
B
P

METHOD OF GROUPING SHEET UNITS BELONGING TO SHEET GROUPS, A GROUPING UNIT AND A SHEET HANDLING SYSTEM

FIELD OF THE DISCLOSURE

The present disclosure relates to a method of grouping sheet units, which belong together in sheet groups, of a sheet stream comprising two superposed sheet units each, to a grouping unit, and to a sheet handling system.

BACKGROUND

Known from the prior art are sheet handling systems that, in addition to a sheet feeding device, e.g., a cutting device, which, from a paper web, furnishes individual sheet units that are arranged side by side and that are subsequently transported to a collecting device for collecting the individual sheet units, comprise a merging unit (assembler). The merging unit, which in the sheet travel direction is disposed downstream of the sheet feeding device, constitutes a paper assembling device. The sheet units of the sheet feeding device, for example, two printed sheets, which are arranged side by side in the sheet travel direction, are assembled one on top of the other by the merging unit. The superposed sheet units, which form the sheet stream, are subsequently transported to the collecting station in which the sheet units are collected. Once all sheet units that belong together, a so-called sheet group, have been deposited in the collecting station, the stack formed therefrom is discharged from the collecting station. The stack discharged from the collecting station can be forwarded for further processing, e.g., folding and/or enveloping, to a device downstream of and/or connected to the collecting station.

Depending on the task to be processed, the individual sheet groups may comprise an even or an uneven number of sheet units. It is possible for consecutive sheet groups to comprise different numbers of sheet units. It is also possible for a sheet group to consist of only one sheet unit. The sheet units of a sheet stream, which are furnished by the sheet feeding device and which are assembled one on top of the other by the merging unit, need not necessarily belong to the same sheet group. To ensure an orderly grouping of the sheet units that belong to a sheet group, superposed sheet units that do not belong to a sheet group must be fed separately to the collecting station, which requires that the sheet stream be temporarily interrupted. This leads to a reduction of the cycle efficiency of the sheet handling system.

EP 1 222 132 B1 discloses a method and a device for forming sheet groups from a plurality of sheet units or sheets, with a sheet feeding device furnishing two individual sheets arranged side by side that are transferred into a merging unit. The merging unit assembles the individual sheets one on top of the other and transfers them into a stopping device disposed upstream of the collecting station. The stopping device serves to transfer the individual sheets into the collecting station. If the superposed individual sheets do not belong to a shared sheet group, the individual sheet that belongs to a downstream subsequent sheet group is held back while the other individual sheet is transferred into the collecting station. Once the sheet group disposed in the collecting station has been discharged, the individual sheet unit held back in the stopping device is transferred into the collecting station.

SUMMARY

One aspect of the disclosure relates to an improved method of grouping sheet units, which belong together in sheet groups. Another aspect of the disclosure relates to a sheet stream comprising two superposed sheet units each. An additional aspect of the disclosure relates to an improved grouping unit. A further aspect of the disclosure relates to a sheet handling system that make possible a high processing speed and a high cycle efficiency of a sheet handling system.

Various embodiments are also disclosed.

To implement the method according to the disclosure, a sheet stream comprising two superposed sheet units is provided. A sheet feeding device preferably furnishes two sheet units arranged side by side that are assembled one on top of the other in a merging unit disposed downstream of the sheet feeding device. The sheet feeding device involved is, for example, a combination of a printer and a cutting device, or a sheet feeder that, by placing the two separate sheet units side by side, prepares these sheet units for transfer into the merging unit. The disclosed method of grouping sheet units, which belong together in sheet groups, of a sheet stream comprising two superposed sheet units each provides for the following steps:

a) Transferring the superposed sheet units into a grouping unit;
b) Transferring the sheet units into a collecting station disposed downstream of the grouping unit if the sheet units transferred into the grouping unit belong to the same sheet group;
c) Or else: Transferring a sheet unit into the collecting station and holding the other sheet unit back in the grouping unit, with the following provisos:
   i) Transferring the held-back sheet unit into the collecting station if this sheet unit is not part of a sheet group of one of the sheet units to be transferred next into the grouping unit;
   ii) Transferring the held-back sheet unit into the collecting station together with both sheet units to be transferred next into the grouping unit if both sheet units to be transferred next into the grouping unit belong to the sheet group of the held-back sheet unit;
   iii) Or else: Transferring the held-back sheet unit, together with the sheet unit, belonging to the same sheet group of the sheet units to be transferred next into the grouping unit and holding the other sheet unit back in the grouping unit and continuing the method using one of the processing steps i) to iii).

According to the disclosed method, preferably a complete sheet group is discharged from the collecting station before a new sheet group is entered into the collecting station. The sheet units are transported through the grouping unit or held back in the grouping unit long enough to ensure that these sheet units reach the collecting station only once the collecting station is ready to receive a new sheet group.

As described above, superposed sheet units of the same sheet group are transported together through the grouping unit into the collecting station. If the superposed sheet units do not belong to the same sheet group, first only one of the two sheet units is transferred into the collecting station. The other sheet unit is held back in the grouping unit and, depending on the downstream subsequent sheet units or, more specifically, on whether these sheet units belong to the sheet group of the sheet held back in the grouping unit, is transferred by itself, together with one or both downstream subsequent sheet units into the collecting station. Thus, except for the case in which a sheet group consists of only one individual sheet unit that has been held back in the grouping unit, it is ensured that the superposed sheet units are continuously transferred into the grouping unit and from there into the collecting station. A loss or delay of time is avoided in that the sheet units need not be grouped into their respective sheet groups. No additional intermediate step is required, in which the superposed sheet units, which do not belong to a sheet group, have to be separated and subsequently be individually transferred to the collecting station. Thus, regardless of whether the superposed sheet units of the sheet stream belong to the same sheet group or to a different sheet group, a high processing speed and cycle efficiency of the sheet handling system and thus a high throughput of sheet units is ensured. A delay caused by having to group the sheet units is avoided. Specifically, the high cycle efficiency of the sheet feeding device, for example, the high performance of a cutting device, can be utilized. Only in cases in which a sheet group consists of only one individual sheet unit that is held back in the grouping unit will an intermediate step and thus a slight time delay be necessary. In this case, the held-back individual sheet unit must be transported from the grouping unit into the ready-to-receive collecting station before the sheet units to be transferred next into the grouping unit are transferred. The transfer of the individual sheet unit into the collecting station is limited only by the transfer of the upstream sheet unit into the collecting station and the discharge of the sheet group disposed in the collecting station, and thus the time it takes to prepare the collecting station for receiving a new sheet group.

Following the processing steps b), i) and ii), the disclosed method is preferably continued with processing step a). Following the processing step iii), the process is continued, as described above, with one of the processing steps i) to iii). This ensures a continuous process for completely processing and grouping a sheet stream comprising two superposed sheet units and for processing all sheet units furnished by the sheet feeding device.

To ensure that the sheet groups are orderly assembled, the following applies to the sheet units transferred into the grouping unit as described in processing step c):

If a sheet unit is part of the sheet group transferred immediately upstream into the collecting station: Transferring this sheet unit into the collecting station and holding the other sheet unit back in the grouping unit;

Or else: Transferring a sheet unit, which is not part of a sheet group of the sheet units next to be transferred into the grouping unit, into the collecting station and holding the other sheet unit back in the grouping unit.

This ensures that the sheet units are orderly assigned to the respective sheet group.

According to a preferred embodiment of the disclosure, the sheet units to be transferred next into the grouping unit are arranged above or below a sheet unit held back in the grouping unit, depending on the sequence of arrangement of the downstream subsequent sheet units or the direction of collection of the sheet units and/or on the arrangement of a sheet unit held back in the grouping unit. Thus, it is possible to arrange or collect the sheet units belonging to a sheet group of the sheet stream in an orderly sequence. If only one of the downstream subsequent sheet units is part of the sheet group of the sheet unit held back in the grouping unit, the other sheet unit can be arranged so as to make it possible for this sheet unit to be held back in the grouping unit. More specifically, the sheet unit to be held back is not arranged between the sheet units belonging to a shared sheet group.

According to a preferred embodiment of the disclosure, the grouping unit comprises a suction device, by means of which a sheet unit is held back in the grouping unit. Using a suction device, it is possible to ensure that a specific sheet unit, which is to be held back, of the sheet stream comprising two superposed sheet units each is held back until it is combined with one or both sheet units to be transferred next into the grouping unit or, where appropriate, until the individual sheet unit is transferred into the ready-to-receive collecting station. In addition to the suction device, the grouping unit preferably also comprises a first transporting unit disposed upstream of the suction device and/or a second transporting unit disposed downstream of the suction device. The first transporting unit serves to feed the sheet units into the suction device, and the second transporting unit serves to transport the sheet units from the suction device into the collecting station. The transporting units also allow the speed at which the sheet units pass through the grouping unit to be determined. In particular, the first transporting unit has the supporting function of holding back a sheet unit. The second transporting unit enables the transfer of the one to three sheet units from the suction device into the collecting station.

Most preferably, the suction device comprises a lower and an upper suction plate. In this context, the term 'above' and 'below', respectively, refer to an element disposed above or below a sheet travel plane (or the center plane of the sheet stream). In addition to holding back an upper sheet unit of the superposed sheet units by means of the upper suction plate, using an overlapping arrangement of the superposed sheet units, i.e., an arrangement in which the superposed sheet units are slightly offset relative to each other in the sheet travel direction, it is also possible for the upper sheet unit to be held back by the lower suction plate. This also applies mutatis mutandis to the lower sheet unit. Regardless of the arrangement of the superposed sheet units of the sheet stream that are transferred into the grouping unit, this makes it possible to arrange the sheet units in the grouping unit in an orderly sequence and thus to maintain the direction of collection. Using a transporting unit disposed upstream and/or downstream of the suction device makes it possible not only to determine the speed at which the sheet units are transferred into the grouping unit and from the grouping unit into the collecting station but also to hold a sheet unit back in the grouping unit. Especially in cases of an overlapping arrangement of the sheet units, the transporting unit disposed upstream of the suction device can serve to brake a sheet unit that is to be held back and to control the transfer of sheet units into the suction device. Using a transporting unit disposed downstream of the suction device can serve to transfer specific sheet units that are to be transferred from the suction device into the collecting station, especially with regard to a sheet unit that is to be held back in the collecting station. At the same time, using the transporting units also makes it possible to control the speed at which the sheet units are transferred into the grouping unit and from the grouping unit into the collecting station.

According to a preferred embodiment of the disclosure, the sheet units are marked with an identifier that identifies which sheet units belong to a sheet group. The identifier, for example, an OMR (Optical Mark Recognition) code, is preferably read out prior to transferring the sheet units into a grouping unit, especially prior to merging them in the sheet feeding device. This makes it possible to control the grouping unit, the merging unit (for example, for controlling an overlapping or non-overlapping arrangement of the sheet units) and/or the collecting station to ensure an orderly grouping of the sheet units belonging together into sheet groups. As an alternative to the identifier described above, it is also possible for the assignment of the sheet units to a sheet group to be filed in advance, i.e., during the generation of a task and the transfer of this information to the sheet feeding device, in the memory of a controlling unit, with the controlling unit controlling the sheet handling system or individual components of the sheet handling system. Using this type of control for controlling the sheet feeding device, the merging unit, the grouping unit and/or the collecting station will also allow an orderly grouping of the sheet units into the respective sheet groups.

According to a preferred embodiment of the method, the superposed sheet units to be transferred into the grouping unit are arranged so as to overlap in the sheet travel direction, i.e., so as to be slightly offset relative to each other in the sheet travel direction. The sheet units arranged side by side in the sheet travel direction and furnished by the sheet feeding device are passed in their overlapping arrangement through the merging unit. The overlapping arrangement of the sheet units is implemented by more slowly moving, or by temporarily holding back, one of the two sheet units in the merging unit. Because of the overlapping arrangement of the sheet units transferred into the grouping unit, an especially simple and favorable way of holding a sheet unit back in the grouping unit is provided. For example, as already described above, it is possible to hold back a sheet unit by means of a suction device and to move the superposed sheet units at differing speeds through a transporting unit. According to an especially preferred embodiment of the disclosed method, only the superposed sheet units that do not belong to the same sheet group are arranged so as to overlap. An overlapping arrangement of the superposed sheet units belonging to the same sheet group provides no advantage since these sheet units are always transferred together into the collecting station, i.e., without holding one of the two sheet units back in the grouping unit. Thus, an unnecessary delay that can occur because of an overlapping arrangement of the sheet units in the merging unit is avoided. In addition, this also facilitates the transport of the sheet units that belong together through the grouping unit into the collecting station.

As already described above, the method provides that, preferably, a complete sheet group is discharged from the collecting station before a new sheet group is entered into the collecting station. This ensures that sheet units of different sheet groups are not mixed up in the collecting station. Once all sheet units belonging to a shared sheet group are deposited in the collecting station, the stack formed therefrom is discharged from the collecting station and subjected to further processing, e.g., folding and/or enveloping, in a device disposed downstream of, or connected to, the collecting station.

The disclosure further comprises a grouping unit for a sheet handling system for grouping sheet units that belong together, of a sheet stream comprising two sheet units each. As already described above, the grouping unit is preferably disposed in the sheet travel direction downstream of a merging unit, which is disposed downstream of the sheet feeding device, and upstream of a collecting station. Superposed sheet units of the same sheet group can be released together from the grouping unit and transported into the collecting station. The grouping unit is further designed such that in cases in which superposed sheet units do not belong to the same sheet group, first only one of the two sheet units can be released and transferred into the collecting station and the other sheet unit can be held back in the grouping unit. According to the present disclosure, the grouping unit is designed to release only the held-back sheet unit by itself and to release this sheet unit together with one other sheet unit and to release this sheet unit together with both downstream subsequent sheet units. Because of the disclosed design of the grouping unit, an especially favorable grouping of sheet units, which belong together in sheet groups, of a sheet stream comprising two sheet units each is ensured. Unnecessary delays caused by having to group the sheet units belonging together in sheet groups is thereby avoided. Regardless of whether the superposed sheet units of the sheet stream transferred into the grouping unit belong to the same sheet group or to different sheet groups, a high processing speed and cycle efficiency during the processing of the sheet units is possible.

According to a preferred embodiment, the grouping unit comprises a transporting system for transporting the sheet units from an input of the grouping unit, into which the sheet units to be transferred to the grouping unit are to be fed, to an output of the grouping unit, from which the sheet units are discharged from the grouping unit, and a holding unit. Thus, both the transporting system and the holding unit make it possible to control the holding of a sheet unit back in the grouping unit and the speed at which the sheet units pass through the grouping unit or, more specifically, the length of time the sheet units remain in the grouping unit. Thus, it is possible not only to orderly group the sheet units into the respective sheet group but also to transfer the sheet units into the collecting station disposed downstream of the grouping unit exactly at the moment when the collecting station is ready to receive a new sheet group.

According to a preferred embodiment, the transporting system of the grouping unit comprises a first transporting unit that is disposed upstream of the holding unit in the sheet travel direction and a second transporting unit that is disposed downstream of the holding unit in the sheet travel direction. The first transporting unit disposed upstream of the holding unit favorably allows the downstream subsequent sheet units to be fed into the holding unit, in particular even if a sheet unit is held back therein. In addition, especially in cases in which the sheet units overlap, the first transporting unit can delay the sheet unit held back in the holding unit relative to the sheet unit not held back in the holding unit. The second transporting unit disposed downstream of the holding unit allows the one to three sheet units, which are to be transferred to the collecting station, to be transferred together to the station. The first transporting unit and the second transporting unit can preferably be controlled or driven independently of each other. Thus, it is possible to especially favorably control the speed at which the individual sheet units are transferred into the holding unit and/or into the collecting station and thus ensure optimum timing of the grouping unit and/or the sheet handling system.

According to an especially preferred embodiment, the first transporting unit and/or the second transporting unit comprises pairs of transport rollers capable of being driven and moved relative to each other. The sheet units are moved in the sheet travel plane extending between the pairs of transport rollers. The transport roller pair transfers the sheet units into the holding unit and/or into the collecting station. The transport roller pair comprises an upper transport roller and a lower transport roller. The upper transport roller and the lower transport roller can preferably be moved relative to each other so that both the upper transport roller and the lower transport roller are in contact with the sheet units disposed in between. Preferably, the transport rollers are driven relative to each other by means of control or drive modules that are assigned to the respective transport roller pairs or to at least one of the respective transport rollers. More specifically, it is possible to design the transport rollers such that only one of the two transport rollers is capable of being driven and the other roller is freely pivotally mounted.

The movement of the upper and lower transport rollers relative to each other and thus also the pressure exerted by the transport rollers on the sheet units passing through in between can be controlled especially by suspensions, which can be activated and which are dedicated to the transport rollers, or by spring units. More specifically, it is possible to design the transport rollers such that only one of the two transport rollers is capable of moving in the direction of the other transport roller. Regardless of the number of sheet units passing between the transport rollers, the above-described design of the first and the second transporting unit ensures that the one to three sheet units are reliably guided, especially without damaging the sheet units.

According to an especially preferred embodiment, the grouping unit on the input side, i.e., on the side facing the merging unit and the sheet feeding device, has an assigning unit, by means of which the downstream subsequent sheet units can be routed above or below a sheet unit held back in the holding unit. This allows the downstream subsequent sheet units to be fed in without problems, even in cases in which the holding unit is configured as the suction device, in which holding unit a sheet unit can be held back by an upper or a lower suction plate. Regardless of the arrangement or the assembling sequence of the downstream subsequent sheet units, it is possible to orderly merge these sheet units with a sheet unit held back in a holding unit and thus to orderly group the sheet units in the assembling sequence or direction of collection intended for the sheet group. If only one of the downstream subsequent sheet units is part of the sheet group of the sheet unit held back in the grouping unit, the other sheet unit can be arranged such that this sheet unit is especially not disposed between the sheet units belonging to a shared sheet group and that it can be held back in the grouping unit or in the holding unit.

The assigning unit most preferably comprises three superposed rollers, with one of the rollers being disposed so as to be capable of moving relative to the other rollers. The outside rollers are preferably capable of being moved relative to the middle roller. According to a favorable embodiment, at least one of the three rollers can be driven to transport the downstream subsequent sheet units in the direction of the holding unit. According to a possible embodiment, for example, the middle roller is capable of being driven and the two outside rollers are free pivotally mounted. However, it is also possible for all three of the rollers to be capable of being driven. In addition to reliably guiding the sheet units between two of the three rollers, the direction of rotation of the middle roller and/or a switch upstream of the rollers make for a simple configuration of the assigning unit, which makes it possible for the sheet units to be routed between the upper and the middle roller or the middle and the lower roller and thereby allows the downstream subsequent sheet units, which are next to be transferred into the grouping unit, to be routed above or below a sheet unit that has been held back in a holding unit.

According to a favorable configuration of the grouping unit, the holding unit comprises a suction device. Using a suction device makes it possible to hold back a specific sheet unit of the sheet stream comprising two superposed sheet units. In contrast to the stopping points known from the prior art, in which a stop elements is provided for holding back or stopping individual sheet units, which frequently causes damage to the sheet units, the suction device will not damage the sheet units. The suction device most preferably comprises a lower suction plate and an upper suction plate, with the sheet stream being orderly routed between the lower suction plate and the upper suction plate. By applying negative pressure to the suction cups, the sheet units can be picked up and engaged by the lower suction plate or the upper suction plate and thereby be held back in the holding unit. If the sheet units are arranged so as to overlap, i.e., if they are arranged so as to be slightly offset in the sheet travel direction, it is possible for the lower suction plate to hold back the upper sheet unit. This also applies mutatis mutandis to the lower sheet unit. Holding back a sheet unit by means of the lower or upper suction plate facilitates routing the sheet units transferred downstream into the grouping unit above or below the held-back sheet unit. Regardless of the arrangement of the superposed sheet units of the sheet stream transferred into the grouping unit, it is thus possible to assemble the sheet units in an orderly sequence in the grouping unit and thereby maintain the intended direction of collection of the sheet units.

The sheet handling system described above preferably comprises a sheet feeding device for generating a sheet stream comprising two sheet units each, a grouping unit disposed downstream of the sheet feeding device for grouping sheet units that belong together, and a collecting station disposed downstream of the grouping unit. According to the present disclosure, the grouping unit is configured as in one of the above-described preferred embodiments. The sheet feeding device preferably comprises a sheet cutting device for producing two side-by-side sheet units. Most preferably, a merging unit for assembling the sheet units produced one on top of the other is disposed downstream of the sheet feeding device, with the merging unit preferably being designed to assemble the superposed sheet units to form an overlap. Thus, a sheet handling system having the advantages described above is made available, which system is marked in particular by a high processing speed and high cycle efficiency during the formation of the individual sheet groups.

BRIEF DESCRIPTION OF THE DRAWINGS

The disclosure will be described based on the practical examples below with reference to the accompanying drawings. The drawings show:

FIGS. 1A to 1C: a portion of a method for grouping sheet units belonging to specific sheet groups in a grouping unit in a first possible constellation of the sheet units belonging to sheet groups;

FIGS. 2A to 2D: a portion of a method for grouping sheet units belonging to specific sheet groups in a grouping unit in a second possible constellation of the sheet units belonging to sheet groups;

DETAILED DESCRIPTION

To explain the method according to the present disclosure, FIGS. 1 to 4 show four portions of the method for grouping sheet units belonging to specific sheet groups in a grouping unit in possible constellations of the sheet units belonging to sheet groups. By way of an example, FIGS. 1 to 4 also show individual processing steps that are carried out when grouping the sheet units in the grouping unit and the subsequent transfer into a collecting station. The letters A, B, C, D of the individual sheet units indicate that these sheet units belong to a sheet group. Sheet units with identical letters belong to a shared sheet group. The hatched sheet units shown in FIGS. 1 to 4 indicate that, although these sheet units belong to a specific sheet group, they are not directly relevant to the description of the scenario described in the respective figures. Arrow P denotes the direction of the sheet stream, i.e., the sheet travel direction.

FIG. 1A shows the base situation of a first constellation of sheet units that are arranged one on top of the other and that are to be transferred into the grouping unit. The sheet units to be transferred into the grouping unit are both part of the sheet group A. As shown in FIG. 1B, the sheet units are transferred together into the grouping unit. As FIG. 1C shows, the sheet units are being transferred together into the collecting station while the downstream subsequent sheet units are being transferred into the grouping unit.

FIG. 2A shows the base situation of a second constellation of sheet units that are arranged one on top of the other and that are to be transferred into the grouping unit. The sheet units to be transferred into the grouping unit belong to the different sheet groups A and B. As shown in FIG. 2B, the sheet units are transferred together into the grouping unit. The downstream subsequent sheet units to be transferred into the grouping unit are neither part of the sheet group A nor part of the sheet group B, but part of the sheet groups C and C/D (sheet group C or D). As shown in FIG. 2C, the sheet unit belonging to the sheet group A is transferred into the collecting station, and the sheet unit belonging to the sheet group B is held back in the grouping unit. Subsequently, the sheet unit B that has been held back in the grouping unit is transferred into the collecting station, and, as shown in FIG. 2D, the sheet unit belonging to the sheet group A has already been discharged from the collecting station. Only once the sheet group B has been transferred into the collecting station will the downstream subsequent sheet units C, C/D be transferred into the grouping unit.

Figures 3A, 3B, 3C, 3D, 3E:
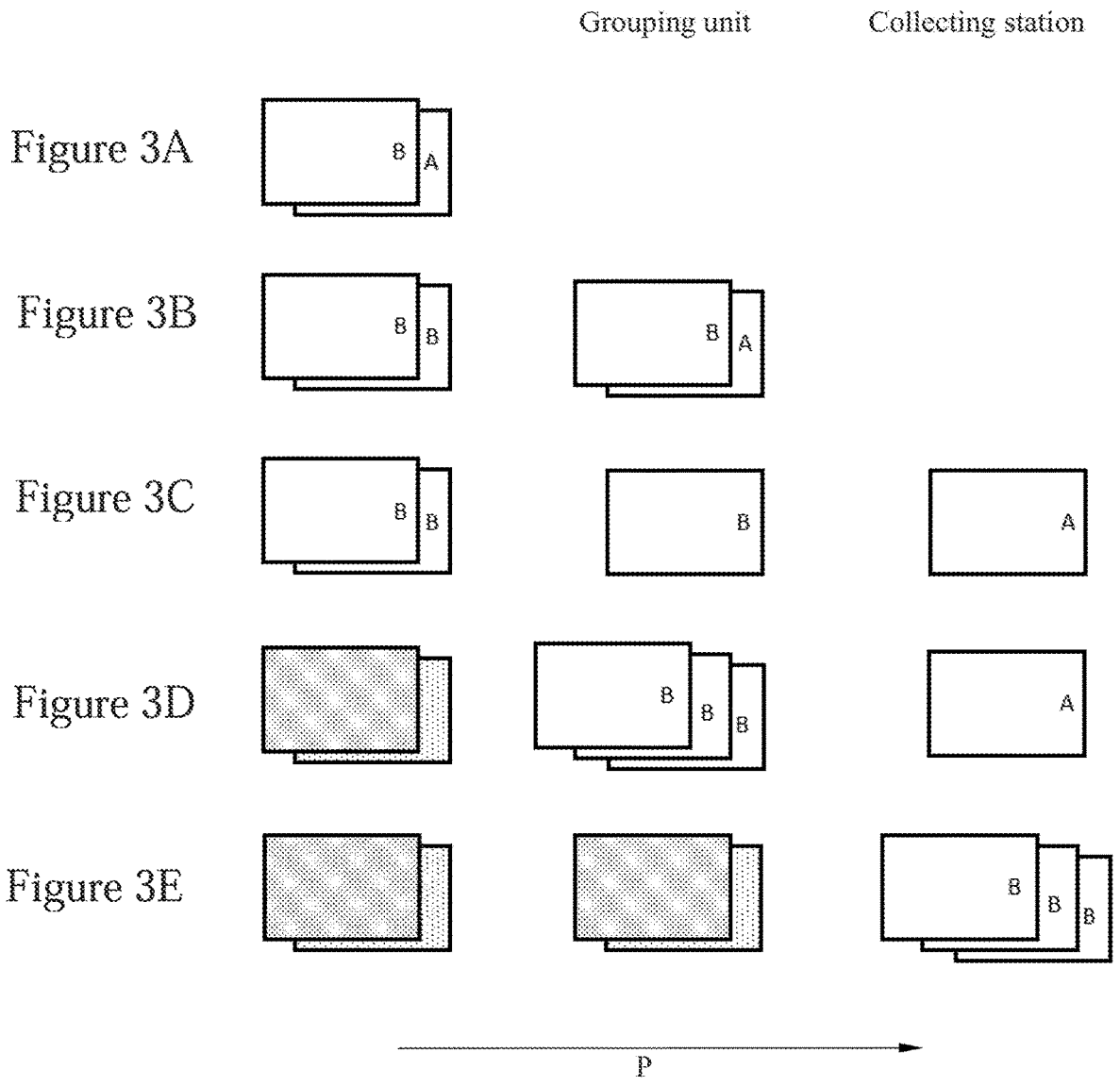
FIGS. 3A to 3E: a portion of a method for grouping sheet units belonging to specific sheet groups in a grouping unit in a third possible constellation of the sheet units belonging to sheet groups.

FIG. 3A shows the base situation of a third constellation of sheet units that are arranged one on top of the other and that are to be transferred into the grouping unit. The sheet units to be transferred into the grouping unit belong to the different sheet groups A and B. As shown in FIG. 3B, the sheet units are transferred together into the grouping unit. Both downstream subsequent sheet units to be transferred into the grouping unit belong to the sheet group B. As shown in FIG. 3C, the sheet unit belonging to the sheet group A is transferred into the collecting station, and the sheet unit belonging to the sheet group B is held back in the grouping unit. While the sheet unit A is being transferred into the collecting station, the two downstream subsequent sheet units B are transferred into the grouping unit where they are joined to the sheet unit B held therein, as shown in FIG. 3D. As an alternative, a transfer of the two downstream subsequent sheet units B at the same time that the sheet unit A is discharged from the collecting station may be an option as well. As shown in FIG. 3E, the three sheet units belonging to the sheet group B are transferred together into the ready-to-receive collecting station. As the sheet units B are being transferred into the collecting station, the downstream subsequent sheet units are already being transferred into the grouping unit.

Figures 4A, 4B, 4C, 4D, 4E:
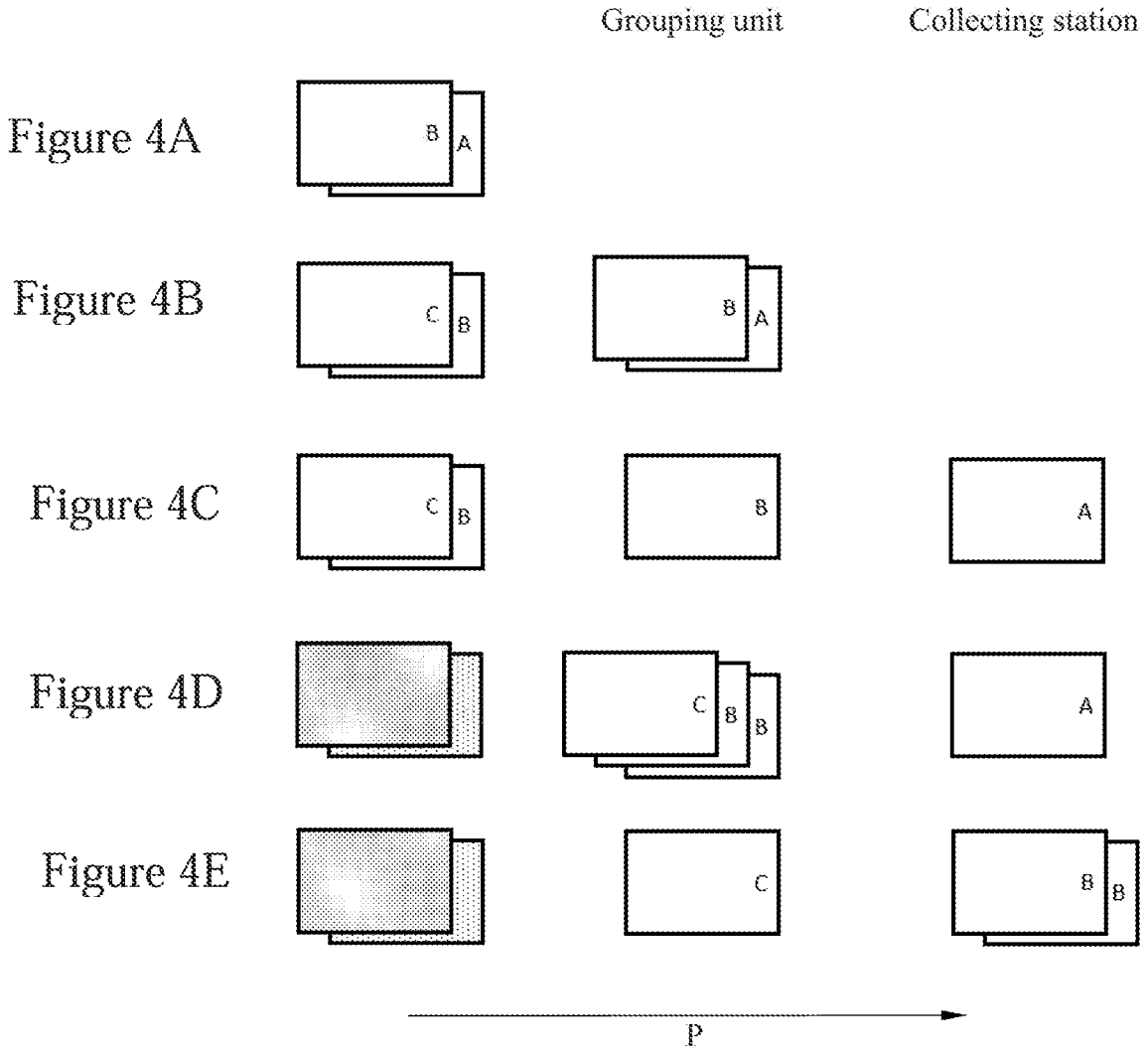
FIGS. 4A to 4E: a portion of a method for grouping sheet units belonging to specific sheet groups in a grouping unit in a fourth possible constellation of the sheet units belonging to sheet groups.

FIG. 4A shows the base situation of a fourth constellation of sheet units that are arranged one on top of the other and that are to be transferred into the grouping unit. The sheet units to be transferred into the grouping unit belong to the different sheet groups A and B. As shown FIG. 4B, the sheet units are transferred together into the grouping unit. The downstream subsequent sheet units to be transferred into the grouping unit belong to the sheet groups B and C. As shown in FIG. 4C, the sheet unit belonging to the sheet group A is transferred into the collecting station, and the sheet unit belonging to the sheet group B is held back in the grouping unit. While the sheet unit A is being transferred into the collecting station, the two downstream subsequent sheet units B, C are transferred into the grouping unit where they are joined to the sheet unit B held therein, as shown in FIG. 4D. After and during the discharge of the sheet unit A from the collecting station, the two sheet units belonging to the sheet group B are transferred together into the ready-to-receive collecting station, as shown in FIG. 4E. The sheet unit C is held back in the grouping unit. As the sheet units B are being transferred into the collecting station, the downstream subsequent sheet units, depending on the sheet group they belong to, can be transferred into the grouping unit. If none of the downstream subsequent sheet units is part of the sheet group C, these sheet units will be transferred into the collecting station only after the sheet unit C has been released from the grouping unit.

The diagrams of the individual processing steps shown in FIGS. 1 to 4 outline only the most important steps of the disclosed method. It should be noted in particular that alternative embodiments with respect to the exact time of the transfer of the sheet units into the grouping unit and of the transfer of sheet units from the grouping unit into the collecting station are possible.

Figure 5:
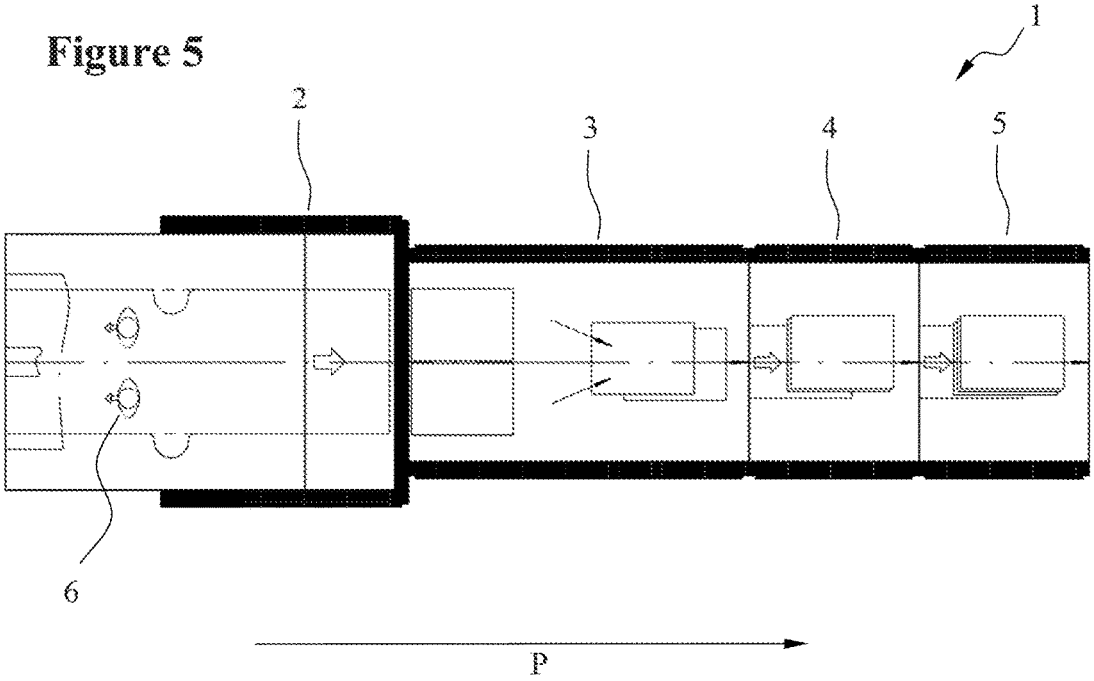
FIG. 5: an overview of the configuration of a sheet handling system.

By way of an example, FIG. 5 shows an overview of the configuration of a sheet handling system 1. As seen when looking in the sheet travel direction P, the sheet handling system 1 comprises a sheet feeding device 2, a merging unit 3, a grouping unit 4 and a collecting station 5. The sheet feeding device 2 involved is, for example, a combination of a printer not shown in the drawing and a cutting device not specifically shown in the drawing. The sheet feeding device 2 furnishes two sheet units arranged side by side from a paper web. The sheet feeding device 2 further comprises a readout device 6 for reading an identifier of the sheet units that identifies which specific sheet group the sheet units belong to. The information with respect to which sheet group the sheet units belong to is used to control the merging unit 3 and/or the grouping unit 4 and/or the collecting station 5. In the sheet handling system 1 shown by way of an example in FIG. 5, the identifier of the sheet units is read already before the paper web is cut into individual sheet units.

As illustrated in FIG. 5, the sheet units arranged side by side, which sheet units are furnished by the sheet feeding device 2, are transferred into the merging unit 3. The merging unit 3 assembles the side-by-side sheet units one on top of the other, as especially indicated by the arrows seen in FIG. 5. The sheet units can be assembled one on top of the other so as to overlap or be flush with each other. Preferably, the merging unit 3 assembles only the superposed sheet units, which do not belong to the same sheet group, so as to overlap. With respect to whether the arrangement should, or should not, overlap, the merging unit 3 can be controlled based on the read-out identifier of the sheet units. Since only the sheet units that do not belong to a sheet group are assembled so as to overlap, an undesirable delay of the process, which would occur if all of the sheet units were assembled in an overlapping arrangement, is avoided.

After the merging unit 3 has assembled the sheet units one on top of the other, these sheet unit are transferred into the grouping unit 4. The grouping unit 4 is designed such that superposed sheet units of the same sheet group are transported through grouping unit 4 into the collecting station 5. The grouping unit 4 is further designed such that in cases in which the sheet units transferred into the grouping unit 4 do not belong to the same sheet group, first only one of the two sheet units is transferred into the collecting station 5 and the other sheet unit is held back in the grouping unit 4. The grouping unit 4 is designed to release the held-back sheet unit both without and together with one or both of the sheet units next transferred into the grouping unit 4. Whether the held-back sheet unit is released without or together with one or both of the sheet units next transferred into the grouping unit 4 depends on which sheet group of the held-back sheet unit the sheet units next transferred into the grouping unit 4 belong to.

Once all sheet units belonging to a shared sheet group have been transferred into the collecting station 5, the stack formed therefrom is discharged from the collecting station 5. The stack discharged from the collecting station 5 can subsequently be forwarded for further processing, e.g., folding and/or enveloping, to a device disposed downstream of, or connected to, the collecting station 5.

Figure 6:
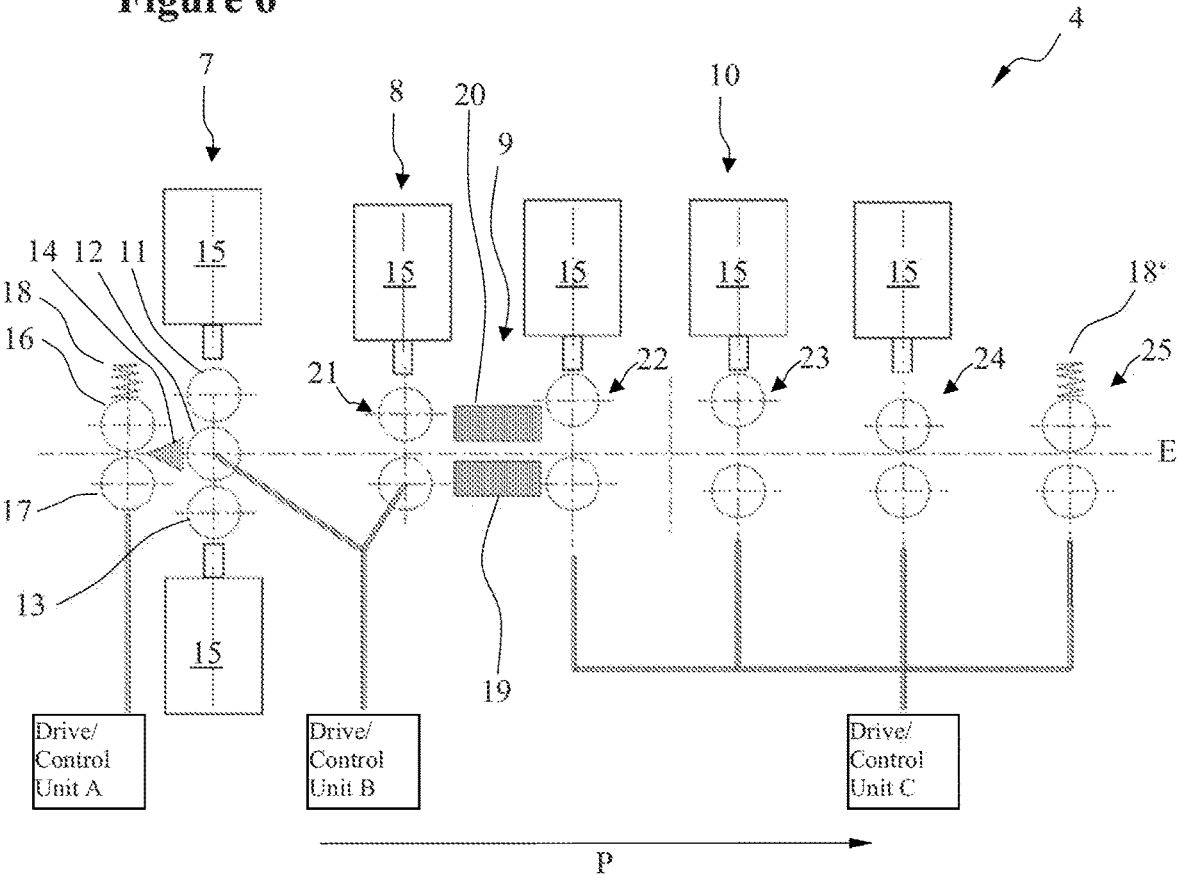
FIG. 6: an embodiment of a grouping unit.

FIG. 6 shows a practical example of a grouping unit 4 according to the disclosure for grouping sheet units that belong together, of a sheet stream consisting of two sheet units each. The sheet stream not shown in the drawing extends substantially in the sheet travel plane E. In this context, the terms 'above' and 'below' used hereinafter always refer to an element disposed above or below the sheet travel plane E shown in the drawing.

The grouping unit 4 comprises an assigning unit 7 disposed on the input side as seen when looking in the sheet travel direction P, a transporting system with a first transporting unit 8 for transporting the sheet units from the assigning unit 7 into a holding unit 9, and a second transporting unit 10 for transporting the one or three sheet units from the holding unit 9 into the collecting station 5 disposed on the output side but not shown in FIG. 6.

The orderly grouping of the sheet units and the transfer of the sheet units into the grouping unit 4 and from the grouping unit into the collecting station 5 is implemented by the interaction of the assigning unit 7, the transporting units 8, 10 and the holding unit 9, which together control both the holding back of a sheet unit in the grouping unit 4 and the speed at which the sheet units pass through the grouping unit 4.

The assigning unit 7 disposed on the input side of the grouping unit 4 makes it possible to feed the sheet units next to be transferred into the grouping unit 4 above or below a sheet unit that is held back in the holding unit 9. Disposed upstream of the assigning unit 7 is a transport module comprising an upper guide roller 16 and a lower guide roller 17. The transport module serves to feed the sheet units from the merging unit 3 to the assigning unit 7. The sheet units are routed between the upper guide roller 16 and the lower guide roller 17. The upper guide roller 16 is disposed on a spring element 18 that enables a movement of the upper guide roller 16 relative to the lower guide roller 17. The lower guide roller 17 is capable of being driven by a first drive/control unit A. More specifically, the first drive/control unit A makes it possible to control the rotational speed of the lower guide roller 17 and thus the speed of a sheet unit that is to be transferred into the grouping unit 4.

The assigning unit 7 shown in FIG. 6 comprises three superposed rollers that are capable of being driven, i.e., an upper roller 11, a middle roller 12 and a lower roller 13. The upper roller 11 and the lower roller 13 are disposed on a suspension 15 that enables a movement of the upper roller 11 and the lower roller 13 relative to the middle roller 12. The middle roller 12 can be driven by a second drive/control unit B. Depending on the routing of the sheet units between the upper roller 11 and the middle roller 12 or between the middle roller 12 and the lower roller 13, the middle roller 12 is capable of being driven in different directions of rotation. More specifically, the second drive/control unit B makes it possible to also control the rotational speed of the middle roller 12. Depending on whether the sheet units transferred into the grouping unit 4 are to be routed above or below a sheet unit held back in the grouping unit 4, the sheet units transferred into the grouping unit 4 are routed between the upper roller 11 and the middle roller 12 or between the middle roller 12 and the lower roller 13. The assigning unit 7 further comprises a switch 14 that is disposed upstream of the three rollers 11, 12, 13. The switch 14 controls the reliable routing of the sheet units between the upper roller 11 and the middle roller 12 or between the middle roller 12 and the lower roller 13.

The first transporting unit 8 shown in FIG. 6 comprises one pair of transport rollers 21, and the second transporting unit 10 comprises four pairs of transport rollers 22, 23, 24, 25. The sheet units are routed between the pairs of transport rollers 21, 22, 23, 24, 25 in the grouping unit 4. The pairs of transport rollers 21, 22, 23, 24, 25 comprise each an upper transport roller and a lower transport roller. Except for the upper transport roller of the pair of transport rollers on the output side that is disposed on a spring element 18', the upper transport rollers are disposed on a suspension 15. The suspensions 15 and the spring element 18' make possible a movement of the upper transport rollers relative to the lower transport rollers. More specifically, the suspension 15 allows the upper transport rollers to be moved sufficiently far in, or away from, the direction of the lower transport rollers so that a reliable routing of the one to three sheet units passing through between these transport rollers is ensured. The individual suspensions 15 allow the distance of each respective upper transport roller from the lower transport roller and thus the holding back of the sheet units disposed in between to be controlled. The lower transport roller of the pair of transport rollers 21 of the first transporting unit 8 is connected to the second drive/control unit B, and the lower transport rollers of the pairs of transport rollers 22, 23, 24, 25 of the second transporting unit 10 are connected to a third drive/control unit C. The lower transport rollers are capable of being driven by the drive/control units B, C. The individual lower transport roller (and the middle roller 12 of the assigning unit 7) can preferably be controlled independently of each other by the drive/control units B, C shown. In particular, by means of the drive/control units B, C, the first transporting unit 8 can also be controlled independently of the second transporting unit 10. In addition to the configuration shown, other configurations of the transporting system, for example, transporting units 8, 10 with more or fewer pairs of transport rollers 21, 22, 23, 24, 25, or a different configuration of a suspension 15 of the upper transport rollers are possible.

The holding unit 9 shown in FIG. 6 is a suction device comprising a lower suction plate 19 and an upper suction plate 20. The sheet stream is routed between the lower suction plate 19 and the upper suction plate 20. By applying negative pressure to the lower suction plate 19 and/or the upper suction plate 20, it is possible for the sheet units to be picked up and held by the lower suction plate 19 and/or the upper suction plate 20 and thereby be held back in the holding unit 9.

Figures 7A, 7B, 7C, 7D:
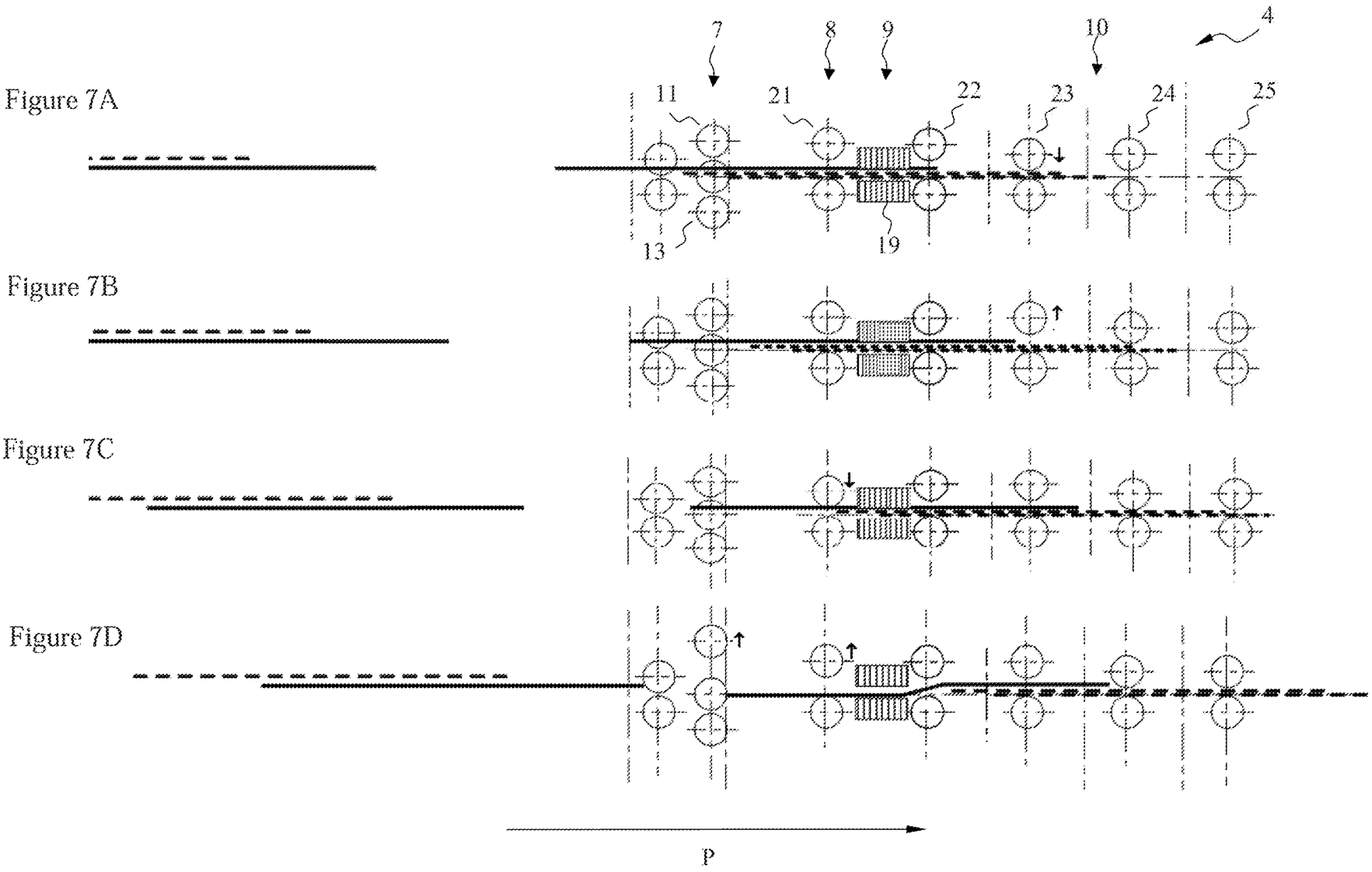
FIGS. 7A to 7D: an example of a portion of the operating cycle of the grouping unit of FIG. 6.

By way of an example, FIGS. 7A to 7D show a portion of individual phases of sheet units routed in the grouping unit 4 of FIG. 6. For the sake of clarity, the drawings show only shortened versions of the grouping unit 4 of FIG. 6 and only a reduced number of the reference characters. The sheet group a sheet unit belongs to is shown by a broken line and a solid line. For the sake of clarity, the orderly way of routing the sheet units through two of the three rollers 11, 12, 13 of the assigning unit 7 is not shown in the drawing. In the base configuration shown in FIG. 7A, the lower sheet unit belonging to a first sheet group as represented by the broken line was held back in the grouping unit 4 by means of the lower suction plate 19 of the holding unit 9 while the downstream subsequent overlapping sheet units are already being routed so as to be disposed above the held-back sheet unit. As the broken lines indicate, the lower sheet unit of the downstream subsequent sheet units is part of the sheet group of the held-back sheet unit. In contrast, the upper sheet unit identified by a solid line is part of a different sheet group. FIGS. 7A to 7D indicate that the two sheet units represented by the broken lines are discharged and that the sheet unit represented by the solid line is held back by the lower suction plate 19. The arrows indicate movements of the upper transport rollers in the direction of and away from the lower transport roller. Since FIGS. 7A to 7D show only a portion of the individual phases of sheet units routed in the grouping unit 4, not all movements of the upper transport rollers are indicated or sketched in. FIGS. 7A to 7D especially show that the two sheet units represented by the broken lines are discharged via the pairs of transport rollers 22, 23, 24, 25 (which move relative to each other) of the second transporting unit 10. FIG. 7C additionally shows the movement of the upper transport roller of the pair of transport rollers 21 of the first transporting unit 8 in the direction of the lower transport roller. The pair of transport rollers 21 of the first transporting unit 8 (in addition to transporting the sheet unit) allows the sheet unit represented by the solid line to be slowed. As a result, discharging the two sheet units represented by the broken lines and holding back the sheet unit represented by the solid line is facilitated. FIG. 7D indicates that routing the downstream subsequent sheet units, which are to be transferred into the grouping unit 4, between the upper roller 11 and the middle roller 12 of the assigning unit 7 and the resulting routing of the sheet units so as to be disposed above the sheet unit held back in the grouping unit is facilitated by the upper roller 11 of the assigning unit 7, which upper roller is moved away from the middle roller 12.

In addition to the embodiments of the sheet handling system and the grouping unit shown by way of an example, other embodiments are possible, by means of which the method according to the disclosure of grouping sheet units, belonging together in sheet groups, of a sheet stream comprising two superposed sheet units each can be carried out.

What is claimed is:

1. A method of grouping sheet units, which belong together in sheet groups, of a sheet stream comprising two superposed sheet units each, the method comprising:

a) transferring the superposed sheet units into a grouping unit;

b) transferring the superposed sheet units into a collecting station disposed downstream of the grouping unit if the sheet units transferred into the grouping unit belong to the same sheet group;

c) otherwise: transferring a sheet unit into the collecting station and holding the other sheet unit back in the grouping station, with the following provisos:

i) transferring the held-back sheet unit into the collecting station if this sheet unit is not part of a sheet group of one of the sheet units to be transferred next into the grouping unit;

ii) transferring the held-back sheet unit into the collecting station together with both sheet units to be transferred next into the grouping unit if both sheet units to be transferred next into the grouping unit belong to the sheet group of the held-back sheet unit;

iii) otherwise: transferring the held-back sheet unit together with the sheet unit belonging to the same sheet group of the sheet units to be transferred next into the grouping unit and holding the other sheet unit back in the grouping unit and continuing the method with one of the processing steps i) to iii).

2. The method of claim 1, wherein following the processing steps b), i) and ii), the method is continued with processing step a).

3. The method of claim 1, wherein the following applies to the sheet units transferred into the grouping unit as described in processing step c):

if a sheet unit is part of the sheet group that was transferred immediately prior thereto into the collecting station: transferring this sheet unit into the collecting station and holding the other sheet unit back in the grouping unit;

otherwise: transferring a sheet unit, which is not part of a sheet group of the sheet units to be transferred next into the grouping unit, into the collecting station and holding the other sheet unit back in the grouping unit.

4. The method of claim 1, wherein, depending on the sequence in which the downstream subsequent sheet units are arranged and/or on the arrangement of a sheet unit held back in the grouping unit, the sheet units to be transferred next into the grouping unit are arranged so as to be disposed above or below a sheet unit held back in the grouping unit.

5. The method of claim 1, wherein the grouping unit comprises a suction device, by means of which a sheet unit is held back in the grouping unit.

6. The method of claim 1, wherein the sheet units are marked with an identifier that indicates which sheet group the sheet units belong to, with the identifier being read out prior to the transfer of the sheet units into the grouping unit.

7. The method of claim 1, wherein the superposed sheet units to be transferred into the grouping unit are arranged so as to overlap in the sheet travel direction.

8. The method of claim 7, wherein only the superposed sheet units, which do not belong to the same sheet group, are arranged so as to overlap.

9. The method of claim 1, comprising the discharge of a complete sheet group from the collecting station prior to feeding a new sheet group into the collecting station.

10. A grouping unit for a sheet handling system, the grouping unit comprising:

a transporting system for transporting sheet units of a sheet stream comprising two superposed sheet units each from an input of the grouping unit to an output of the grouping unit; and a holding unit, wherein the grouping unit groups the sheet units, which belong together in sheet groups, a sheet unit can be held back in the grouping unit, and the grouping unit is designed to release the held-back sheet unit by itself and to release it together with one of two downstream subsequent sheet units and to release it with both downstream subsequent sheet units.

11. The grouping unit of claim 10, wherein the transporting system comprises a first transporting unit that is disposed upstream of the holding unit and a second transporting unit that is disposed downstream of the holding unit.

12. The grouping unit of claim 11, wherein the first transporting unit and/or the second transporting unit includes pairs of transport rollers that are capable of being driven and that can move relative to each other.

13. The grouping unit of claim 10, wherein the grouping unit on its input side comprises an assigning unit, by means of which the downstream subsequent sheet units can be fed so as to be disposed above or below a sheet unit held back in the holding unit.

14. The grouping unit of claim 13, wherein the assigning unit comprises three superposed rollers, wherein at least one of the rollers is disposed so as to be able to move relative to the other rollers.

15. A sheet handling system comprising:

a sheet feeding device for furnishing the sheet stream comprising two superposed sheet units each, the grouping unit of claim 10, and a collecting station disposed downstream of the grouping unit.

16. The sheet handling system of claim 15, wherein the sheet feeding device comprises a sheet cutting device for furnishing two sheet units arranged side by side.

17. The sheet handling system of claim 15, wherein a merging unit for assembling the sheet units one on top of the other is disposed downstream of the sheet feeding device, with the merging unit being designed to release the superposed sheet units in an overlapping arrangement.

18. The grouping unit of claim 10, wherein the holding unit comprises a suction device.

19. A grouping unit for a sheet handling system, the grouping unit comprising:

a transporting system for transporting sheet units of a sheet stream consisting of two sheet units each from an input of the grouping unit to an output of the grouping unit; and a holding unit, wherein the grouping unit groups the sheet units, which belong together in sheet groups, a sheet unit can be held back in the grouping unit, the grouping unit is designed to release the held-back sheet unit by itself and to release it together with one of two downstream subsequent sheet units and to release it with both downstream subsequent sheet units, and the holding unit comprises a suction device.

20. The grouping unit of claim 19, wherein the suction device comprises a lower suction plate and an upper suction plate, with the sheet stream being routed between the lower suction plate and the upper suction plate.

* * * * *